US009330872B2

(12) United States Patent
Kubono et al.

(10) Patent No.: US 9,330,872 B2
(45) Date of Patent: May 3, 2016

(54) ELECTROMAGNETIC RELAY

(71) Applicants: FUJITSU COMPONENT LIMITED, Tokyo (JP); NATIONAL UNIVERSITY CORPORATION SHIZUOKA UNIVERSITY, Shizuoka (JP)

(72) Inventors: Kazuo Kubono, Tokyo (JP); Takashi Yuba, Tokyo (JP); Yoichi Hasegawa, Tokyo (JP); Takuji Murakoshi, Tokyo (JP); Junya Sekikawa, Shizuoka (JP)

(73) Assignees: FUJITSU COMPONENT LIMITED, Tokyo (JP); NATIONAL UNIVERSITY CORPORATION SHIZUOKA UNIVERSITY, Shizuoka (JP)

( * ) Notice: Subject to any disclaimer, the term of this patent is extended or adjusted under 35 U.S.C. 154(b) by 0 days.

(21) Appl. No.: 14/261,512

(22) Filed: Apr. 25, 2014

(65) Prior Publication Data

US 2014/0232489 A1 Aug. 21, 2014

Related U.S. Application Data

(63) Continuation of application No. PCT/JP2013/074513, filed on Sep. 11, 2013.

(30) Foreign Application Priority Data

Sep. 21, 2012 (JP) ..... 2012-208953

(51) Int. Cl.
*H01H 9/30* (2006.01)
*H01H 50/54* (2006.01)

(Continued)

(52) U.S. Cl.
CPC ..... *H01H 50/54* (2013.01); *H01H 9/36* (2013.01); *H01H 9/443* (2013.01); *H01H 50/546* (2013.01)

(58) Field of Classification Search
CPC ..... H01H 9/34; H01H 73/18
USPC ..... 335/201
See application file for complete search history.

(56) References Cited

U.S. PATENT DOCUMENTS 5,546,061 A * 8/1996 Okabayashi et al. ..... 335/78
5,583,328 A 12/1996 Mitsuhashi et al.

(Continued)

FOREIGN PATENT DOCUMENTS

EP 2639804 9/2013
JP 06-020550 1/1994

(Continued)

OTHER PUBLICATIONS

International Search Report mailed on Oct. 8, 2013.

*Primary Examiner* — Alexander Talpalatski
(74) *Attorney, Agent, or Firm* — IPUSA, PLLC

(57) ABSTRACT

An electromagnetic relay includes a contact that includes a fixed contact and a movable contact, a permanent magnet provided on the peripheral side of the contact, and a non-magnetic body. The movable contact is displaceable in a first direction to move toward the fixed contact and in a second direction to move away from the fixed contact. The permanent magnet has a polarity direction perpendicular to the first and second directions. The non-magnetic body faces toward the direction of a Lorentz force that acts based on the permanent magnet in a direct electric current flowing through the contact.

5 Claims, 7 Drawing Sheets

(51) Int. Cl.
*H01H 9/36* (2006.01)
*H01H 9/44* (2006.01)

(56) References Cited

U.S. PATENT DOCUMENTS

| | | | | |
|---|---|---|---|---|
| 6,075,429 | A | 6/2000 | Uotome et al. | |
| 6,700,466 | B1 | 3/2004 | Yamamoto et al. | |
| 7,145,422 | B2 * | 12/2006 | Imanishi et al. | 335/201 |
| 7,157,996 | B2 * | 1/2007 | Enomoto et al. | 335/132 |
| 7,982,564 | B2 * | 7/2011 | Farrar et al. | 335/126 |
| 8,482,368 | B2 * | 7/2013 | Sasaki et al. | 335/201 |
| 8,749,331 | B2 * | 6/2014 | Kashimura et al. | 335/201 |
| 2002/0018332 | A1 | 2/2002 | Kroeker et al. | |
| 2009/0237191 | A1 | 9/2009 | Yano et al. | |
| 2010/0060394 | A1 | 3/2010 | Nagura et al. | |
| 2011/0181381 | A1 * | 7/2011 | Sasaki et al. | 335/78 |
| 2012/0092094 | A1 | 4/2012 | Lee | |
| 2012/0175345 | A1 | 7/2012 | Tachikawa et al. | |
| 2013/0228552 | A1 * | 9/2013 | Kashimura et al. | 218/26 |

FOREIGN PATENT DOCUMENTS

| | | |
|---|---|---|
| JP | 2002-063822 | 2/2002 |
| JP | 2003-197053 | 7/2003 |
| JP | 2007-305468 | 11/2007 |
| JP | 2012-089484 | 5/2012 |
| JP | 2013-232290 | 11/2013 |
| WO | 2011147458 | 12/2011 |

* cited by examiner

ELECTROMAGNETIC RELAY

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2013/074513, filed on Sep. 11, 2013 and designating the U.S., which claims priority to Japanese Patent Application No. 2012-208953, filed on Sep. 21, 2012. The entire contents of all of the foregoing applications are incorporated herein by reference.

BACKGROUND OF THE INVENTION

1. Field of the Invention

The present invention relates to electromagnetic relays that turn on and off electrical apparatuses. Examples of electromagnetic relays include those for domestic use, industrial use, and on-vehicle use.

2. Description of the Related Art

For example, an electromagnetic relay as described in Japanese Laid-Open Patent Application No. 2012-89484 allows and interrupts a flow of electric current in an electrical circuit by closing and opening a pair of contacts formed by a fixed contact and a movable contact. There is concern about generation of an arc when a voltage becomes higher than a minimum arc voltage or an electric current becomes larger than a minimum arc current at the time of the fixed contact and the movable contact in contact with each other separating from each other with a movement of the movable contact in a direction away from the fixed contact or the fixed contact and the movable contact out of contact with each other moving toward each other with a movement of the movable contact in a direction toward the fixed contact.

SUMMARY OF THE INVENTION

According to an aspect of the present invention, an electromagnetic relay includes a contact that includes a fixed contact and a movable contact, wherein the movable contact is displaceable in a first direction to move toward the fixed contact and in a second direction to move away from the fixed contact, a permanent magnet provided on a peripheral side of the contact, wherein the permanent magnet has a polarity direction perpendicular to the first and second directions, and a non-magnetic body that faces toward a direction of a Lorentz force that acts based on the permanent magnet in a direct electric current flowing through the contact.

DESCRIPTION OF THE EMBODIMENTS

In the electromagnetic relay as described in Japanese Laid-Open Patent Application No. 2012-89484, the technique of extinguishing an arc by deflecting and blowing off the arc by bending its direction by causing an electromagnetic force (Lorentz force) based on Fleming's left-hand rule to act on the arc based on the magnetic flux of a magnet positioned near the contacts, using the fact that an arc has the same magnetic properties as an electric current, may be applied. In the case of considering improving the interrupting performance by deflecting and elongating an arc, however, it becomes more difficult to ensure a space for elongating an arc as the electromagnetic relay becomes smaller in external size, so that there is a problem in that improvement in the arc extinguishing effect and reduction in size may not be fully achieved at the same time.

Embodiments of the present invention are described below with reference to the accompanying drawings.

First Embodiment

Figure 1:
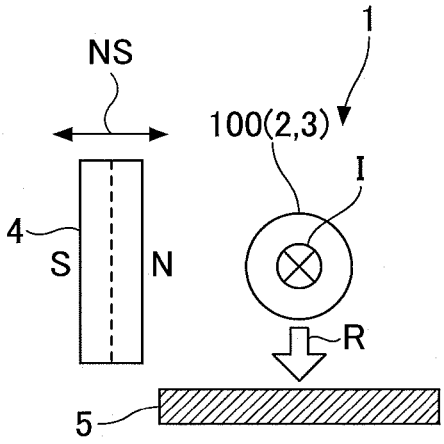
FIG. 1 is a schematic diagram illustrating part of an electromagnetic relay according to a first embodiment of the present invention.
Figure 2:
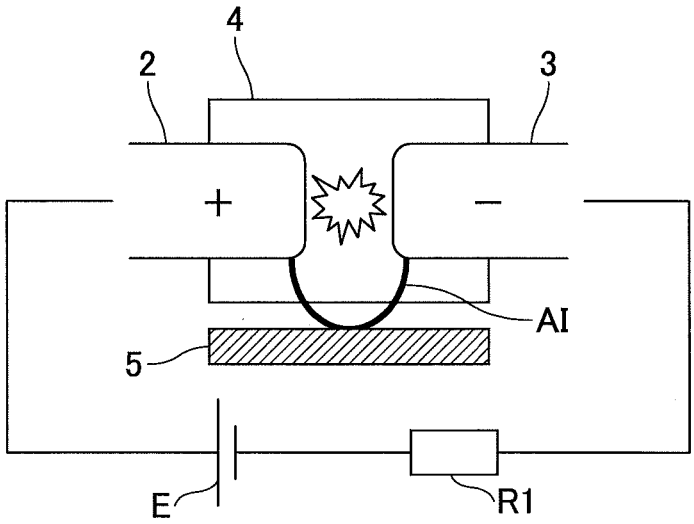
FIG. 2 is a schematic diagram illustrating part of the electromagnetic relay according to the first embodiment.

FIG. 1 is a schematic diagram illustrating part of an electromagnetic relay according to a first embodiment, viewed in a direction in which a movable contact moves away (separates) from a fixed contact. FIG. 2 is a schematic diagram illustrating part of an electromagnetic relay according to the first embodiment, viewed in a direction toward a permanent magnet.

Referring to FIG. 1 and FIG. 2, an electromagnetic relay 1 according to the first embodiment includes a fixed contact 2 and a movable contact 3, which is displaceable in directions toward and away from the fixed contact 2. The fixed contact 2 and the movable contact 3 have a columnar shape and form a contact 100. An electric current flows in a direction I (the direction going into the plane of the paper of FIG. 1) at the contact 100. The fixed contact 2 and the movable contact 3 are arranged side by side to face each other in the direction I. The direction I coincides with the direction in which the movable contact 3 moves away from the fixed contact 2.

The electromagnetic relay 1 further includes a permanent magnet 4. The permanent magnet 4 has a north pole N and a south pole S as illustrated in FIG. 1. A direction from the north pole N to the south pole S and a direction from the south pole S to the north pole N are the magnetic directions of the permanent magnet 4, which are indicated by a double-headed arrow NS. The direction of a Lorentz force that acts on an arc at the contact 100 is indicated by an arrow R in FIG. 1. The permanent magnet 4 is placed beside the contact 100 on its peripheral side so that its magnetic directions NS are perpendicular to the direction I and the direction R. That is, the magnetic directions NS are perpendicular to the directions in which the movable contact 3 moves toward and away from the fixed contact 2.

The electromagnetic relay 1 further includes a metal plate 5 (a non-magnetic body) having a flat plate shape. The metal plate 5 is placed beside the contact 100 so as to be perpendicular to the direction R, which is perpendicular to both the magnetic directions NS and the direction I. The metal plate 5 faces toward the direction of the Lorentz force that acts based on the permanent magnet 4 in a direct electric current flowing through the contact 100. FIG. 1 illustrates a case where an electric current flows from the fixed contact 2 to the movable contact 3 at the contact 100.

That is, as illustrated in FIG. 2, an arc discharge AI is generated with an arcuate shape that continues from the movable contact 3 to the fixed contact 2 when viewed in a direction toward the north pole side of the permanent magnet 4 with the fixed contact 2, forming the positive electrode of the contact 100, and the movable contact 3, forming the negative electrode of the contact 100, being arranged side by side.

The arc discharge AI (also simply referred to as "arc") starts when an electric current starts to flow through an air gap between a surface of the fixed contact 2 and a surface of the movable contact 3 with an electrical load being imposed between the fixed contact 2 and the movable contact 3 connected to a power supply E and an appropriate resistor R1 to form a closed circuit as illustrated in FIG. 2. The surfaces of the fixed contact 2 and the movable contact 3 are heated at the boundary between the surface of the fixed contact 2 and the arc discharge AI and the boundary between the surface of the movable contact 3 and the arc discharge AI, that is, a positive electrode root and a negative electrode root, respectively. The positive electrode root is heated by electron impact and the negative electrode root is heated by ion impact. The positive electrode and the negative electrode are also heated by heat conduction and radiation from the arc discharge AI. This heating at both the positive electrode and the negative electrode causes the material of the positive electrode and the negative electrode to evaporate, so that the wear of both the fixed contact 2 and the movable contact 3 increases.

Therefore, according to the electromagnetic relay 1 of the first embodiment, in the light of both improvement of the durability and improvement of the interrupting performance of the contact 100, the generated arc discharge AI is more effectively extinguished by appropriately arranging a non-magnetic body and a permanent magnet.

Figure 3:
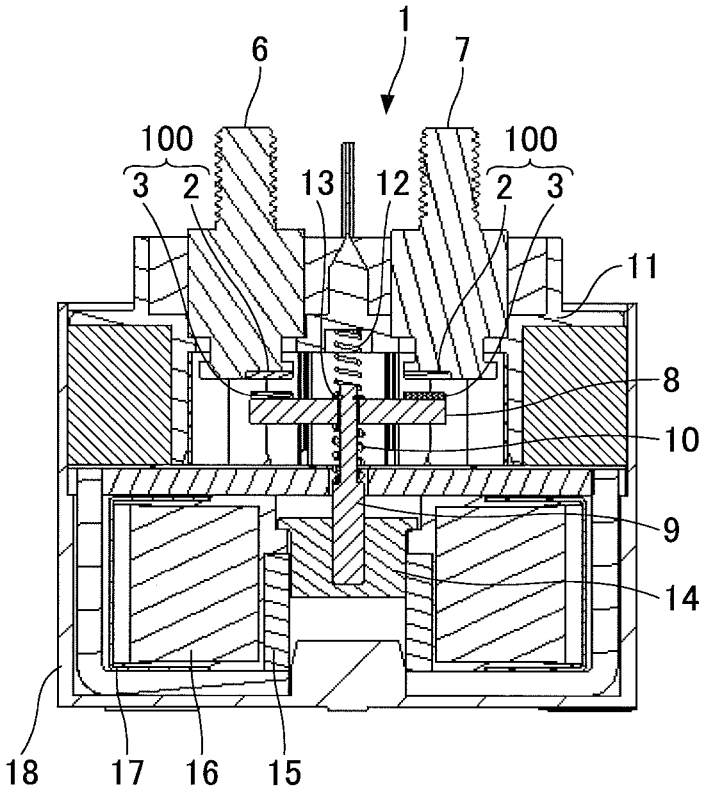
FIG. 3 is a cross-sectional view of the electromagnetic relay according to the first embodiment.

Next, an overall configuration of the electromagnetic relay 1 of the first embodiment is described. FIG. 3 is a schematic diagram illustrating a cross section of the electromagnetic relay 1 that passes the central axis line of a movable iron core and a shaft core. As illustrated in FIG. 3, the electromagnetic relay 1 is a plunger type and is a one form X type, which has one pair of contacts with respect to a shaft core. That is, as illustrated in FIG. 3, the electromagnetic relay 1 includes a pair of right and left contacts 100. In FIG. 3, the fixed contact 2 of the left contact 100 is connected to a positive terminal 6 and the fixed contact 2 of the right contact 100 is connected to a negative terminal 7. FIG. 2 illustrates a combination of a positive electrode and a negative electrode at the left contact 100 in FIG. 3. The positions of the fixed contact 2 and the movable contact 3 illustrated in FIG. 2 are reversed at the right contact 100 in FIG. 3.

The movable contacts 3 of the right and left contacts 100 are placed at the right end and the left end, respectively, of a movable part 8 having a rectangular parallelepiped shape. The movable part 8 is connected to a shaft core 9 via a contact pressure spring 10. An upper end portion of the shaft core 9 in FIG. 3 is connected to a housing 11, which fixes the positive terminal 6 and the negative terminal 7, via a return spring 12 and an E-type retaining ring 13. A lower end portion of the shaft core 9 is connected to a hole, which has a bottom, of a movable iron core 14 so as to be slidable in its axial directions.

An annular yoke 15 is provided around the movable iron core 14. A coil wire 16 is wound and provided around the yoke 15. A barrier 17 for electromagnetic shielding is provided around the coil wire 16. A yoke 18 having a bottom lid shape, which is suitably joined to the housing 11, is provided to support and enclose both a lower end portion of the yoke in FIG. 3 and the coil wire 16.

Figure 4B:
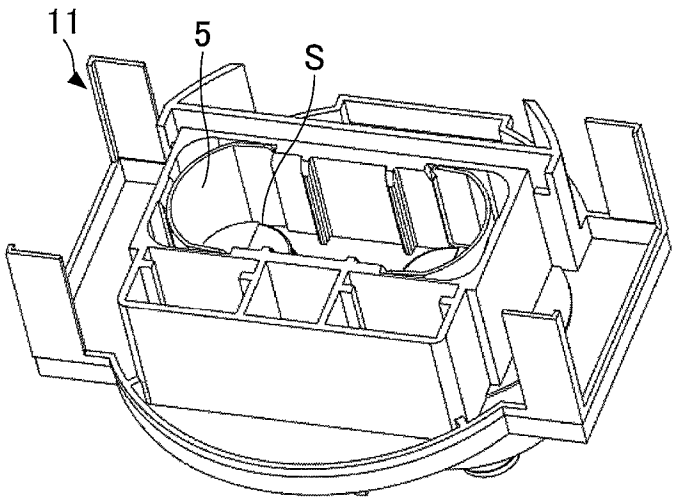
FIGS. 4A and 4B are schematic diagrams illustrating shapes of non-magnetic bodies of the electromagnetic relay and their fixation to a box component according to the first embodiment.
Figure 4A:
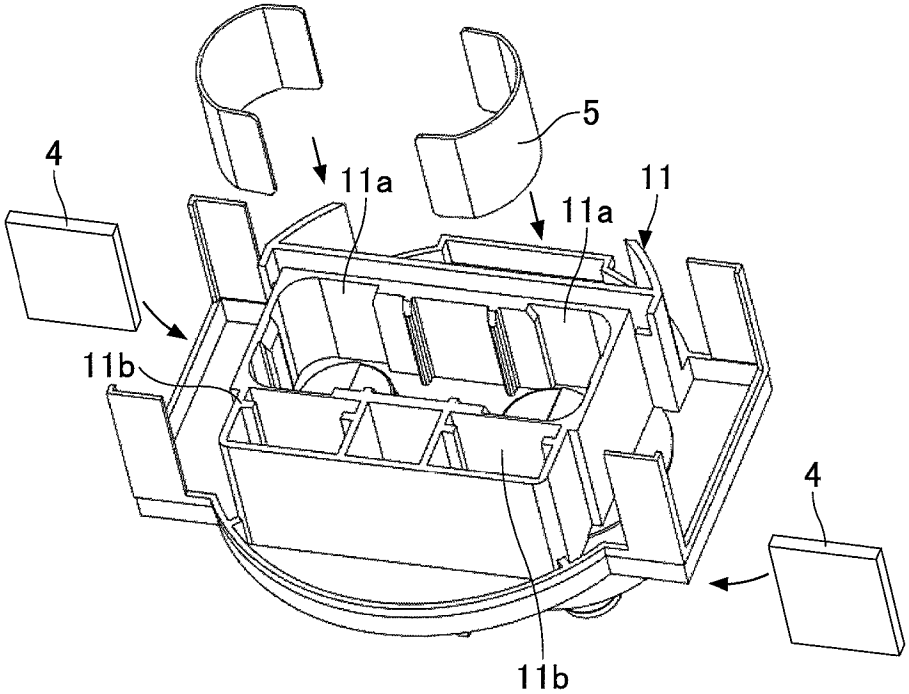

The electromagnetic relay 1 includes a pair of metal plates 5. The metal plates 5 are formed of, or formed using as a principal component, one of non-magnetic materials, which are not ferromagnetic materials, such as copper, aluminum, stainless steel, and silver. The shape of the metal plates 5 may be a flat plate shape as illustrated in the conceptual diagrams of FIG. 1 and FIG. 2. In view of the elongation of the arc discharge AI blown off by a Lorentz force on the surface of each of the metal plates 5, however, each of the metal plates 5 preferably has a shape that covers the contact surfaces of the contact 100 from radial directions with respect to the directions in which the movable contact 3 moves toward and away from the fixed contact 2 as a center as illustrated in FIG. 4A. In FIG. 4A, a letter U column shape is selected as an example of this cover shape. The housing 11 includes a pair of recesses 11*a* where these metal plates 5 of a letter U column shape may be accommodated and fixed by press fitting. Each of the recesses 11*a* is positioned on the outer peripheral side of the corresponding contact 100, and is shaped so as to allow the corresponding metal plate 5 of a letter U column shape to be press-fitted into the recess 11*a* from the direction in which the movable contact 3 moves away from the fixed contact 2 (from the upward direction in FIG. 4A). The metal plates 5 are press-fitted and fixed to the corresponding recesses 11*a* as illustrated in FIG. 4B. Furthermore, as illustrated in FIG. 4A, the electromagnetic relay 1 includes a pair of permanent magnets 4 having a flat plate shape, and the housing 11 further includes a pair of recesses 11*b* where the permanent magnets 4 may be accommodated and fixed by press fitting. The permanent magnets 4 are press-fitted and fixed to the corresponding recesses 11*b*. Furthermore, the internal space of the housing 11, which is a box component, is subjected to neither evacuation nor gas injection.

The coil wire 16 includes a terminal, which is not illustrated in FIG. 3. With no excitation current applied to the terminal, the shaft core 9 and the movable iron core 14 are urged downward in FIG. 3 based on the urging force of the return spring 12, so that a transition to the open state of the contacts 100, each formed of the fixed contact 2 and the movable contact 3, is made or the open state of the contacts 100 is maintained. When an excitation current is applied to the terminal, a force to attract the movable iron core 14 upward in FIG. 3, generated by the coil wire 16, the yoke 15, and the yoke 18, causes the shaft core 9 and the movable part 8 to move upward, so that the movable contacts 3 come into contact with the corresponding fixed contacts 2 to close the contacts 100.

Figure 5:
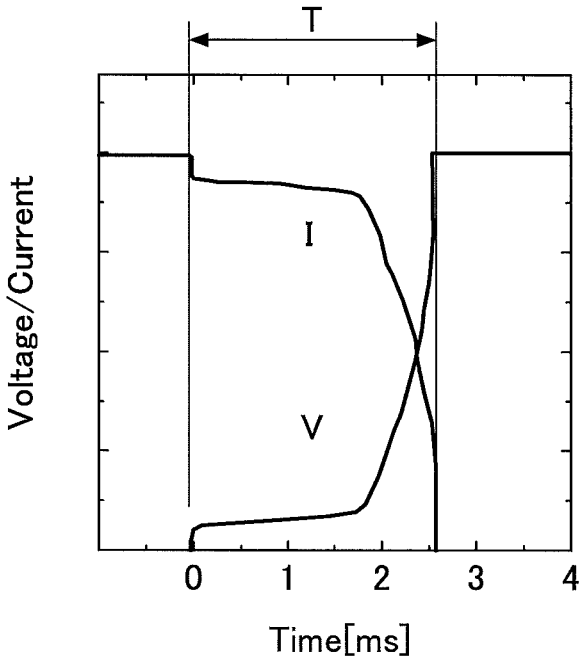
FIG. 5 is a schematic graph illustrating the definition of an arc interruption time that serves as grounds for the determination of a distance between non-magnetic bodies and corresponding contacts of the electromagnetic relay according to the first embodiment.

When measured before and after the interruption of an arc at the contact 100 on the closed circuit illustrated in FIG. 2, a voltage V and a current I show waveforms illustrated in FIG. 5. After decreasing stepwise at the beginning of the interruption, the current I gradually decreases for approximately 2 ms, and thereafter, rapidly drops. After increasing stepwise at the beginning of the interruption, the voltage V gradually increases for approximately 2 ms, and thereafter, rapidly rises to reach a predetermined value.

Figure 6:
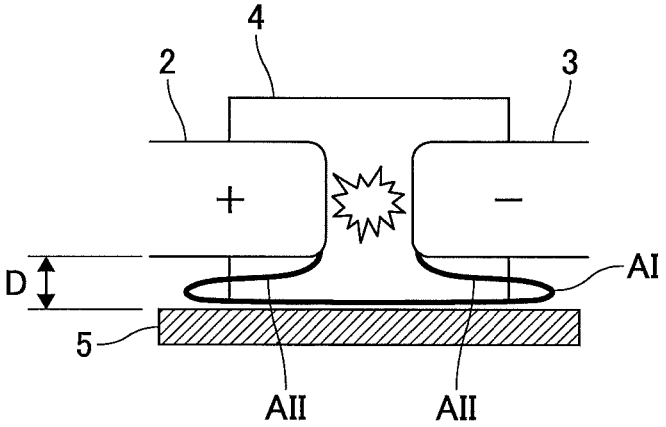
FIG. 6 is a schematic diagram illustrating the details of arc extinction in the electromagnetic relay according to the first embodiment, viewed in a direction toward a permanent magnet.
Figure 7:
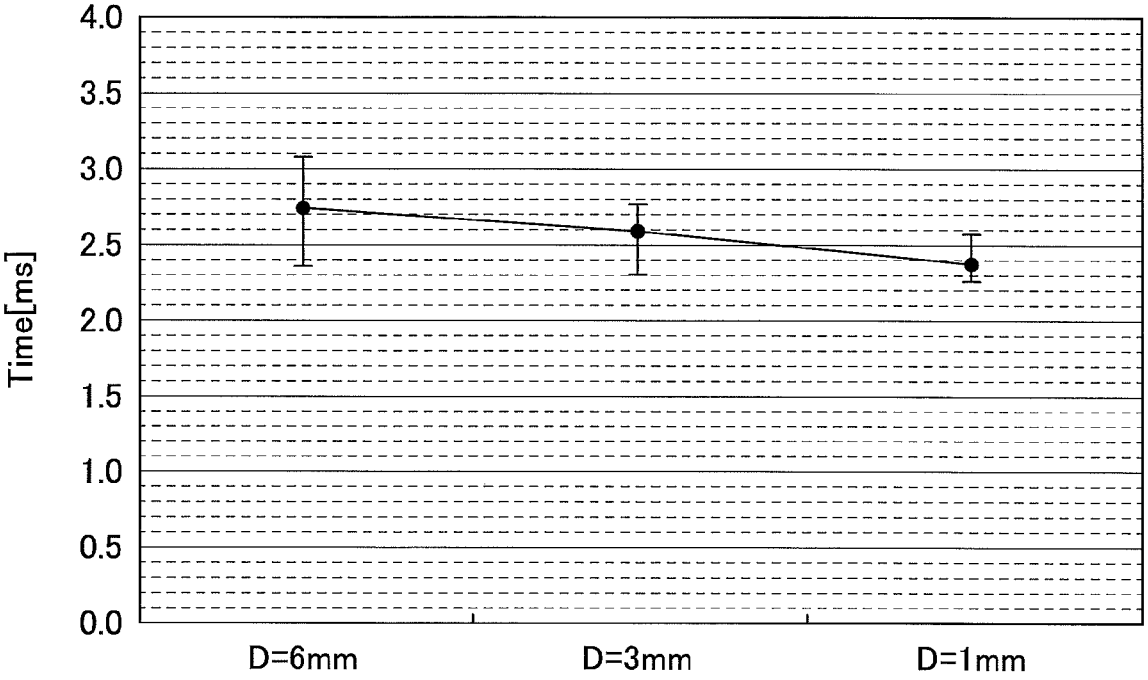
FIG. 7 is a schematic graph illustrating a characteristic that is a correlation between an arc interruption time and a distance between non-magnetic bodies and corresponding contacts of the electromagnetic relay according to the first embodiment.

An arc interruption time T at the contacts 100 of the electromagnetic relay 1 is the time from the stepwise decrease of the current I to the arrival of the voltage V at the predetermined value. A shorter arc interruption time T indicates that a shorter time is required to extinguish the arc discharge AI. The relationship between the arc interruption time T and a distance D between each of the fixed contact 2 and the movable contact 3 of each of the contacts 100 and the corresponding metal plate 5 in a direction in which the arc discharge AI is blown off in FIG. 6 is a gradual decrease of the arc interruption time T relative to a decrease in the distance D as illustrated in FIG. 7.

In causing the arc discharge AI blown off by a Lorentz force to collide with the metal plates 5 more effectively, it is possible to ensure higher collision energy with a shorter distance D. Too small a distance D, however, makes it difficult to ensure a gap required to elongate the arc discharge AI into an inverted Ω shape as illustrated in FIG. 6 between a side face of the fixed contact 2 or a side face of the movable contact 3 of each of the contacts 100 and the corresponding metal plate 5. In addition, the side face of the fixed contact 2 is substantially the positive terminal 6 or the negative terminal 7, and if the positive terminal 6 or the negative terminal 7 includes, for example, an iron-based ferromagnetic material, the arc discharge AI may enter the positive terminal 6 or the negative terminal 7.

In this case, the arc discharge AI is prevented from being sufficiently elongated along the surface of the metal plate 5 between each of the contacts 100 and the corresponding metal plate 5. Therefore, when the characteristic illustrated in FIG. 7 is obtained by an experiment or a simulation in the electromagnetic relay 1 of the first embodiment, the distance D is set to a value greater than a minimum value of 1 mm, for example, approximately 1.5 mm (a predetermined range).

According to the electromagnetic relay 1 of the first embodiment, by providing the permanent magnet 4 and the non-magnetic metal plate 5 that have the above-described positional relationship near each of the contacts 100, it is possible to obtain the following effects.

That is, when the arc discharge AI generated in the gap between the fixed contact 2 and the movable contact 3 with the opening or closing of each of the contacts 100 is blown off by a Lorentz force, it is possible to elongate the arcuate arc discharge AI along the surface of the metal plate 5 as illustrated in FIG. 6 because the metal plate is disposed so as to face toward the direction of the acting Lorentz force. In FIG. 6, the metal plate 5 has a flat plate shape for convenience of illustration.

That is, according to the electromagnetic relay 1 of the first embodiment, it is possible to deflect and blow off the arc discharge AI, generated between the fixed contact 2 and the movable contact 3 at each of the contacts 100 when the movable contact 3 moves toward and away from the fixed contact 2, toward a direction away from the contact 100 by an electromagnetic force (Lorentz force) based on Fleming's left-hand rule, generated by a magnetic flux generated by the permanent magnet 4 and the arc discharge AI, and to cause the blown-off arc discharge AI to collide with the metal plate 5 (a non-magnetic body). By elongating the arc discharge AI in a plane direction of the metal plate 5 by this collision and causing the thermal energy of the arc discharge AI to be absorbed by the non-magnetic body, and making a distance over which the arc discharge AI extends between the fixed contact 2 and the movable contact 3 as long as possible, it is possible to extinguish the arc discharge AI more swiftly.

Figure 8A:
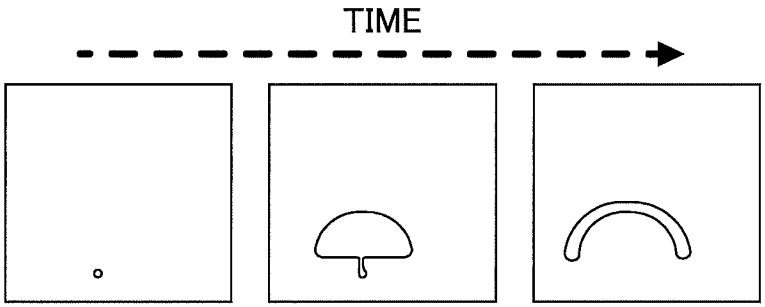
FIGS. 8A and 8B are schematic diagrams for illustrating arc extinction in the electromagnetic relay 1 according to the first embodiment based on a comparison with related art.
Figure 8B:
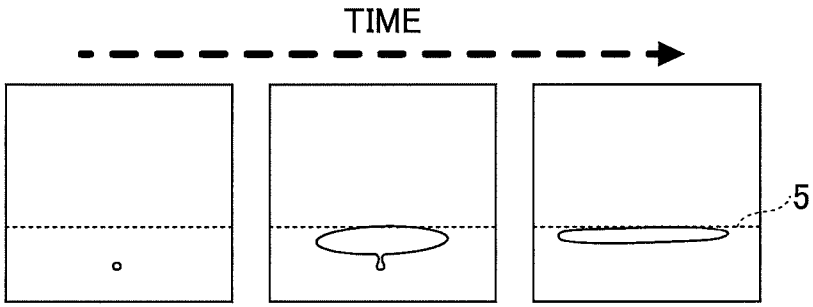

That is, in the case where no metal plate 5 is provided in the direction in which the arc discharge AI is blown off by a Lorentz force, the arc discharge AI forms an arcuate shape and simply bulges radially as illustrated in FIG. 8A, while by providing the metal plates 5, which are non-magnetic bodies, it is possible to elongate the arc discharge AI on the surfaces of the metal plates 5 without the arc discharge AI entering the metal plates 5 as illustrated in FIG. 8B. Therefore, the thermal energy of the arc discharge AI is absorbed by the metal plates 5 over a wider area, and the extension distance of the arc discharge AI in a space is increased, so that it is possible to extinguish the arc discharge AI more effectively.

Furthermore, the metal plates 5 of the first embodiment also serve to prevent the collision of the arc discharge AI with the housing 11. Therefore, it is possible to prevent the housing 11 from being damaged by the arc discharge AI and to prevent degradation of the contact characteristics of each of the contacts 100 by preventing generation of gas due to damage to resin that forms the housing 11. Furthermore, because it is possible to prevent generation of gas by preventing damage to the housing 11 serving as a box component, it is possible to reduce cost by subjecting the internal space of the housing 11 to neither evacuation nor gas injection.

In addition, by minimizing, by providing the metal plates 5, a space required to ensure the interrupting performance by elongating the arc discharge AI and reducing its thermal energy, it is possible to downsize the housing 11 and also the entire electromagnetic relay 1. In other words, it is possible to improve the interrupting performance irrespective of the external size of an electromagnetic relay.

According to the electromagnetic relay 1 of the first embodiment, both the permanent magnets 4 and the metal plates 5 are fixed to the housing 11, serving as a box component forming an outer shell, by press fitting. Alternatively, the permanent magnets 4 and the metal plates 5 may be unitarily fixed to the housing 11 by being embedded in advance in the housing 11 by insert molding.

By employing the latter molding method, it is possible to fix the permanent magnets 4 and the metal plates 5 to the housing 11 by insert molding in a single process, so that it is possible to improve assemblability and manufacturability.

Second Embodiment

Figure 9B:
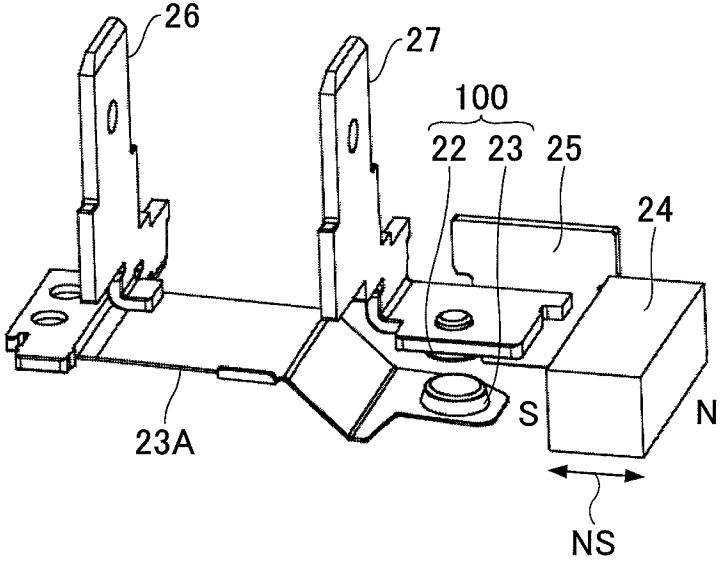
FIGS. 9A and 9B are schematic diagrams illustrating an outline and part of an electromagnetic relay according to a second embodiment of the present invention.
Figure 9A:
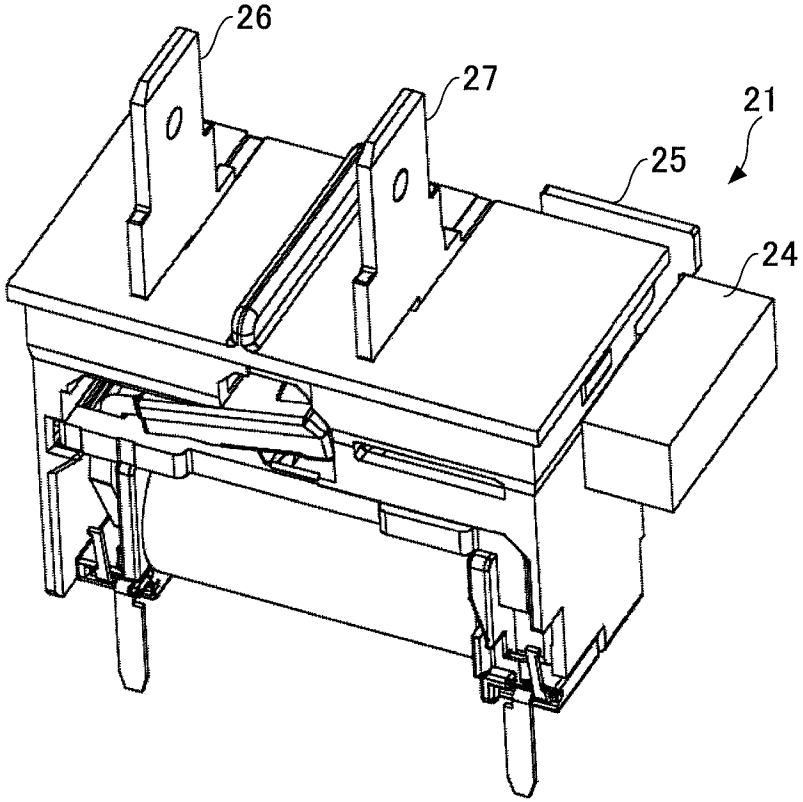

In the above-described first embodiment, the case where the present invention is applied to a plunger-type electromagnetic relay is illustrated, while the present invention may also be applied to an arm-type (hinge-type) electromagnetic relay. A second embodiment, where the present invention is applied to an arm-type electromagnetic relay, is described below. FIG. 9A illustrates an outline of an electromagnetic relay 21 according to the second embodiment, and FIG. 9B is an enlarged view of part of the electromagnetic relay 21.

As illustrated in FIG. 9A, the electromagnetic relay 21 of the second embodiment is an application of the present invention to an arm-type and one form X type electromagnetic relay. As illustrated in FIG. 9B, a fixed contact 22 and a movable contact 23, which form a contact 100, face toward each other in directions in which the movable contact 23 moves toward and away from the fixed contact 22, and a permanent magnet 24 is positioned to face toward a direction from the supporting point to the end point of a movable arm 23A, which supports the movable contact 23. A non-magnetic metal plate 25 is positioned to face toward a direction in which an arc discharge AI, flowing in the direction in which the movable contact 23 moves toward or away from the fixed contact 22, is blown off by a Lorentz force acting on the arc discharge AI because of the magnetic force of the permanent magnet 24. The metal plate 25 is provided on the side of the supporting point of the movable arm 23A relative to the permanent magnet 24. The movable arm 23A is connected to a positive terminal 26 and the fixed contact 22 is connected to a negative terminal 27.

A housing, serving as a box component that forms an outer shell, and a drive part, including a coil wire and yokes for driving the movable arm 23A, which form the electromagnetic relay 21, are functionally equal in structure to those of the plunger-type electromagnetic relay 1 of the first embodiment, and accordingly, their detailed description is omitted. The electromagnetic relay 21 of the second embodiment is an arm type, and in terms of ensuring a space required for the swinging of the movable arm 23*a*, it is not appropriate to provide the metal plate 25 in such a manner as to externally cover the contact 100 around the direction in which the movable contact 23 moves toward and away from the fixed contact 22. Therefore, the metal plate 25 has a flat plate shape.

According to the electromagnetic relay 21 of the second embodiment, it is possible to deflect and blow off the arc discharge AI, generated between the fixed contact 22 and the movable contact 23 when the movable contact 23 moves toward and away from the fixed contact 22, toward a direction away from the contact 100 by an electromagnetic force (Lorentz force) based on Fleming's left-hand rule, generated by a magnetic flux generated by the permanent magnet 24 and the arc discharge AI, and to cause the blown-off arc discharge AI to collide with the metal plate (a non-magnetic body). Based on this collision, like in the first embodiment, it is possible to extinguish the arc discharge AI more swiftly by weakening the arc discharge AI by elongating the arc discharge AI in a plane direction of the metal plate 25 and causing the thermal energy of the arc discharge AI to be absorbed by the non-magnetic body, and making the extension distance of the arc discharge AI between the fixed contact 22 and the movable contact 23 as long as possible. Like in the first embodiment, it is also possible to obtain the housing protection effect and the downsizing effect in the second embodiment.

Preferred embodiments of the present invention are described in detail above. The present invention, however, is not limited to the above-described embodiments, and variations and modifications may be made to the above-described embodiments without departing from the scope of the present invention.

What is claimed is:

1. An electromagnetic relay, comprising:

a contact that includes a fixed contact and a movable contact, wherein the movable contact is displaceable in a first direction to move toward the fixed contact and in a second direction to move away from the fixed contact;

a permanent magnet provided on a peripheral side of the contact, wherein the permanent magnet has a polarity direction perpendicular to the first and second directions; and a non-magnetic metal body that faces toward a direction of a Lorentz force that acts on a direct electric current flowing through the contact based on the permanent magnet.

2. The electromagnetic relay as claimed in claim 1, wherein the non-magnetic metal body has a flat plate shape or a cover shape that covers the contact.

3. The electromagnetic relay as claimed in claim 1, wherein a distance between the non-magnetic metal body and the contact is determined based on a characteristic between the distance and a breaking time of the contact.

4. The electromagnetic relay as claimed in claim 1, further comprising:

a housing that forms an outer shell of the electromagnetic relay, wherein the permanent magnet and the non-magnetic metal body are fixed to the housing by being press-fitted into recesses of the housing.

5. An electromagnetic relay, comprising:

a plurality of contacts each including a fixed contact and a movable contact, wherein each movable contact is displaceable in a first direction to move toward the fixed contact and in a second direction to move away from the fixed contact;

a permanent magnet provided on a peripheral side of the plurality of contacts, wherein the permanent magnet has a polarity direction perpendicular to the first and second directions; and a plurality of non-magnetic metal bodies each facing toward a direction of a Lorentz force that acts on a direct electric current flowing through one of the plurality of contacts based on the permanent magnet, wherein the non-magnetic bodies are provided across the plurality of contacts from each other.

* * * * *